US006175966B1

(12) United States Patent
Wiesenthal

(10) Patent No.: US 6,175,966 B1
(45) Date of Patent: Jan. 23, 2001

(54) GARMENT HAVING A CLOSEABLE POCKET WHICH CONCEALS EMBROIDERY AND METHOD OF PRODUCING A GARMENT HAVING A CLOSEABLE POCKET WHICH CONCEALS EMBROIDERY

(75) Inventor: Marc Wiesenthal, Short Hills, NJ (US)

(73) Assignee: Vantage Customs Classics, Inc., Avenel, NJ (US)

( * ) Notice: Under 35 U.S.C. 154(b), the term of this patent shall be extended for 0 days.

(21) Appl. No.: 09/256,132

(22) Filed: Nov. 25, 1998

(51) Int. Cl.[7] ..... A41D 27/20; A41D 27/08
(52) U.S. Cl. ..... 2/247; 2/243.1; 2/244
(58) Field of Search ..... 2/247, 243.1, 244; 112/475.18, 475.09, 475.08

(56) References Cited

U.S. PATENT DOCUMENTS 4,138,745 * 2/1979 Greenspan .
5,379,461 * 1/1995 Wilmers .
5,509,147 * 4/1996 Busquets ..... 2/253
5,628,065 * 5/1997 Austin ..... 2/81
5,669,078 * 9/1997 Scremin et al. ..... 2/247
5,784,718 * 7/1998 Finnegan ..... 2/90
5,832,540 * 11/1998 Knight ..... 2/247
5,901,372 * 5/1999 Lawler ..... 2/69

* cited by examiner

*Primary Examiner*—John J. Calvert
*Assistant Examiner*—Shirra L. Jenkins
(74) *Attorney, Agent, or Firm*—Cooper & Dunham LLP

(57) ABSTRACT

A garment having an interior closeable pocket designed to conceal the backing of post-production embroidery on the garment. Standard embroidering equipment may be inserted into said pocket to produce a garment having a closeable pocket designed to conceal the backing of post-production embroidery on the garment. The pocket includes a closeable opening which conceals post-production embroidery and which is large enough to accommodate standard embroidering equipment.

8 Claims, 5 Drawing Sheets

GARMENT HAVING A CLOSEABLE POCKET WHICH CONCEALS EMBROIDERY AND METHOD OF PRODUCING A GARMENT HAVING A CLOSEABLE POCKET WHICH CONCEALS EMBROIDERY

FIELD OF THE INVENTION

This invention relates to a garment having a closeable pocket, and more particularly, to a garment having an interior closeable pocket which is designed to conceal the backing of post-production embroidery on the garment. This invention also relates to methods of producing the pocket. The garments can be pre-made and custom embroidered after production.

BACKGROUND OF THE INVENTION

There presently is a large demand for custom embroidered garments which bear a name, logo, design or other designation desirable to a particular, small segment of the population, such as schools, businesses, colleges, recreational sports teams, resorts and the like. These entities desire garments bearing their special names, logos, designs or designations. Typically, there is only a small market for such branded items, namely the members of the particular entity, and a relatively small number of garments are required. It is necessary for a garment manufacturer to produce small numbers of garments, such as jackets, bearing the logos, designs, names or designs of various customers. Typically, the most cost-effective means to meet the demand for custom-branded goods is to produce a large number of standard garments, such as jackets, in a variety of standard sizes and colors, which have no embroidery and which can later be embroidered with the names, logos, designs and designations as requested.

Names, logos, designs and other designations typically are applied to a garment by direct embroidery on the garment. While such designations can be produced as separate appliques and heat-sealed to the garment, this process is time consuming and is not cost effective. Moreover, not all designations, particularly those comprising only letters and words, are suitable to be produced as appliques. Further, such appliques do not provide the professional, finished quality produced by embroidery, and can become unfastened from the garment through normal wear and tear.

The standard embroidery process employed in the decoration of garments produces the desired design on the exterior of a garment, but a visible embroidery backing on the interior of the garment. In garments which are embroidered before completion, the unsightly embroidery backing can be concealed by a lining or by the design of the garment itself. However, where garments are pre-made before embroidery, the embroidery backing cannot be concealed, as the garment already is constructed. This is particularly true where the pre-made garment is a shirt, jacket or other garment where the reverse embroidery is visible when the garment is worn open. Typically, garments such as jackets are embroidered on the left breast. When the jacket is worn open, as opposed to buttoned or zippered, the embroidery backing is visible.

There is a need for a garment which can be pre-made and embroidered after construction in which the backing of embroidery placed thereon after the garment is constructed ("post-construction") is concealed. The present invention answers this need by providing a garment with a closeable interior pocket which allows the garment to be embroidered with standard embroidery equipment post-production. The pocket is then fastened to completely conceal the embroidery backing.

Various types of pockets appear on the insides of jackets and other types of apparel. These pockets have an opening which is typically placed on the inside left panel of the garment and which runs in the horizontal direction. The size of the known pockets is usually 5–6 inches in width and 6–7 inches in length, due to standard construction equipment. Vertically disposed pockets also are known and also normally have an opening of about 5–6 inches in width and 6–7 inches in length, again due to standard garment construction equipment.

In the embroidered apparel industry embroiderers have difficulty stitching logos to garments having the usual pockets. Because the most popular embroidery zone is the left chest area, to embroider this area on those garments, such as jackets, with an inside pocket requires the pocket to be sewn shut and rendered useless. As lined jackets typically have full front zippers, the backing of the embroidery is apparent on the inside of the jacket when the jacket is open and not zippered, thereby lowering the value of the garment to a consumer.

SUMMARY OF THE INVENTION

It is therefore an object of the present invention to provide a garment having an interior pocket which conceals the backing of post-production embroidery on said garment.

It is a further object of the patent invention to provide a garment having a closeable pocket which is made to accommodate standard embroidery equipment which embroiders the garment without stitching the pocket closed.

It is another object of the present invention to provide a method for producing a garment having a closeable pocket which conceals the backing of post-production embroidery on said garment.

It is a further object of the present invention to provide a method for producing a garment having a closeable pocket that allows the use of standard embroidery equipment to embroider the garment without stitching the pocket closed.

The foregoing objects are achieved and the disadvantages of the known pocket designs are overcome by providing a garment in accordance with the present invention. The pocket includes an opening running in the vertical direction relative to a wearer of the garment. The opening is adjacent to the front vertical opening of the garment.

The pocket is oversized to accommodate insertion of standard embroidery equipment and is approximately 8–9 inches in width and 10–11 inches in length. The pocket opens in the vertical (length) direction and the opening measures approximately 9 inches.

The method for producing the garment with the closeable pocket on the inside lining of the garment comprises the steps of cutting a vertical slit into the garment's lining or facing to form the opening of the pocket; sewing the facing of the pocket to the pocket's top lining; sewing the front edge of the top lining to the back side of a closure means, preferably a zipper, Velcro tape or other hook and loop fastening tape; opening the top and bottom lining of the pocket and framing the front of the closure means to the vertical slit by turning a raw edge of the vertical slit under a finished edgestitch so as to catch the garment lining and the bottom and top lining of the pocket; reinforcing the top and bottom of the closure mechanism with extra tacking in the horizontal direction; sewing the bottom and top lining of the pocket closed; sewing through the bottom and top lining of the pocket so as to catch a top of the pocket to keep it flat; and catching, while setting the sleeve lining of the garment, a back edge of the pocket to reinforce the pocket's stitch construction and further secure the pocket.

BRIEF DESCRIPTION OF THE DRAWINGS

The features and advantages of the invention will become apparent upon review of the following detailed description of the preferred embodiment, taken in conjunction with the following drawings, in which.

DETAILED DESCRIPTION

The present invention relates to a garment having an interior closeable pocket which is designed to conceal the backing of post-production embroidery on the exterior of the garment. The oversized closeable pocket permits insertion of standard embroidery equipment. A preferred embodiment is a garment with a zippered pocket that appears on the left inside breast of a lined jacket.

Figure 1:
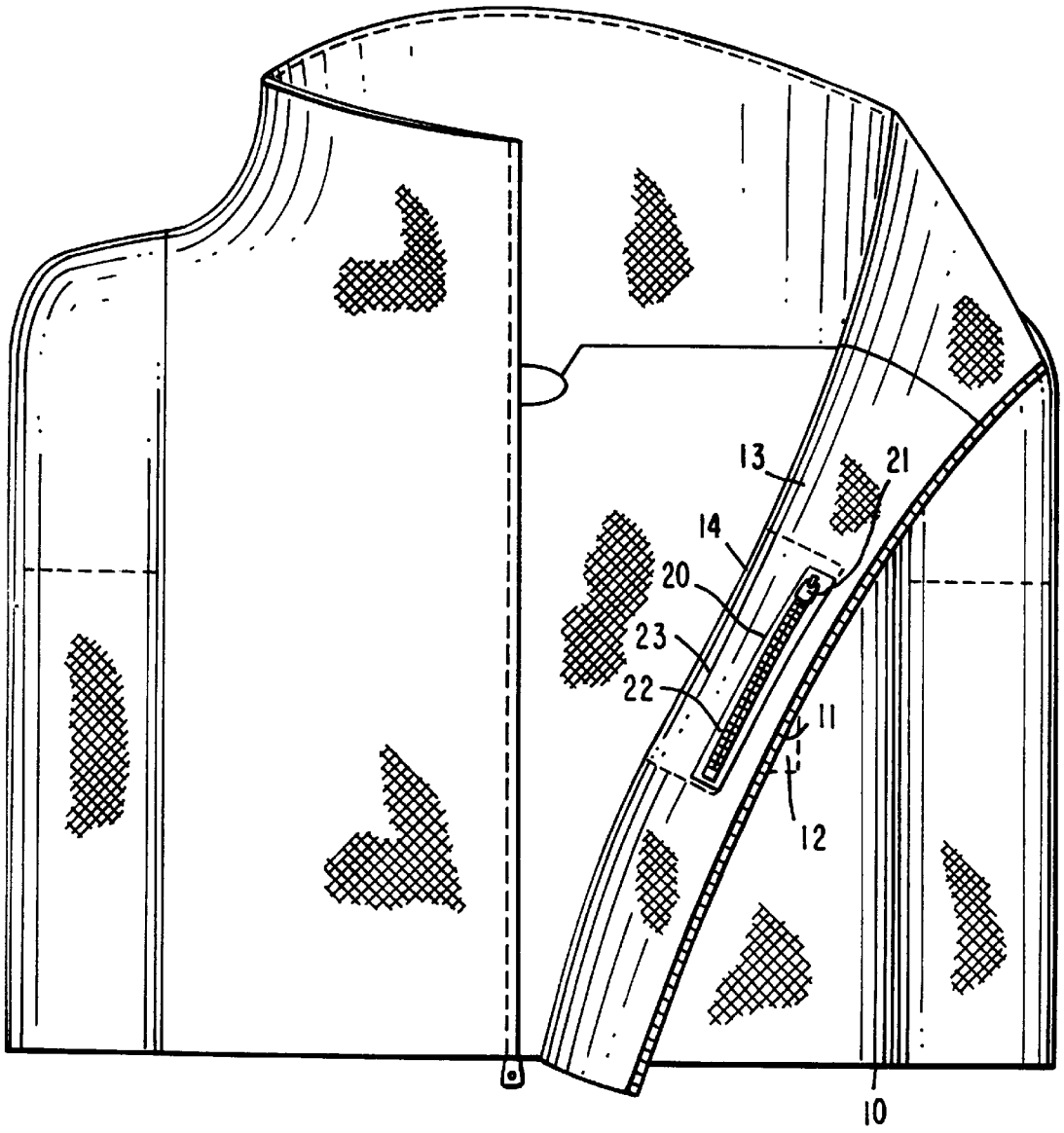
FIG. 1 is a front view of a jacket having a closeable pocket located adjacent the front opening of the jacket and extending to the inside left breast of the jacket according to the preferred embodiment of the present invention.
Figure 2:
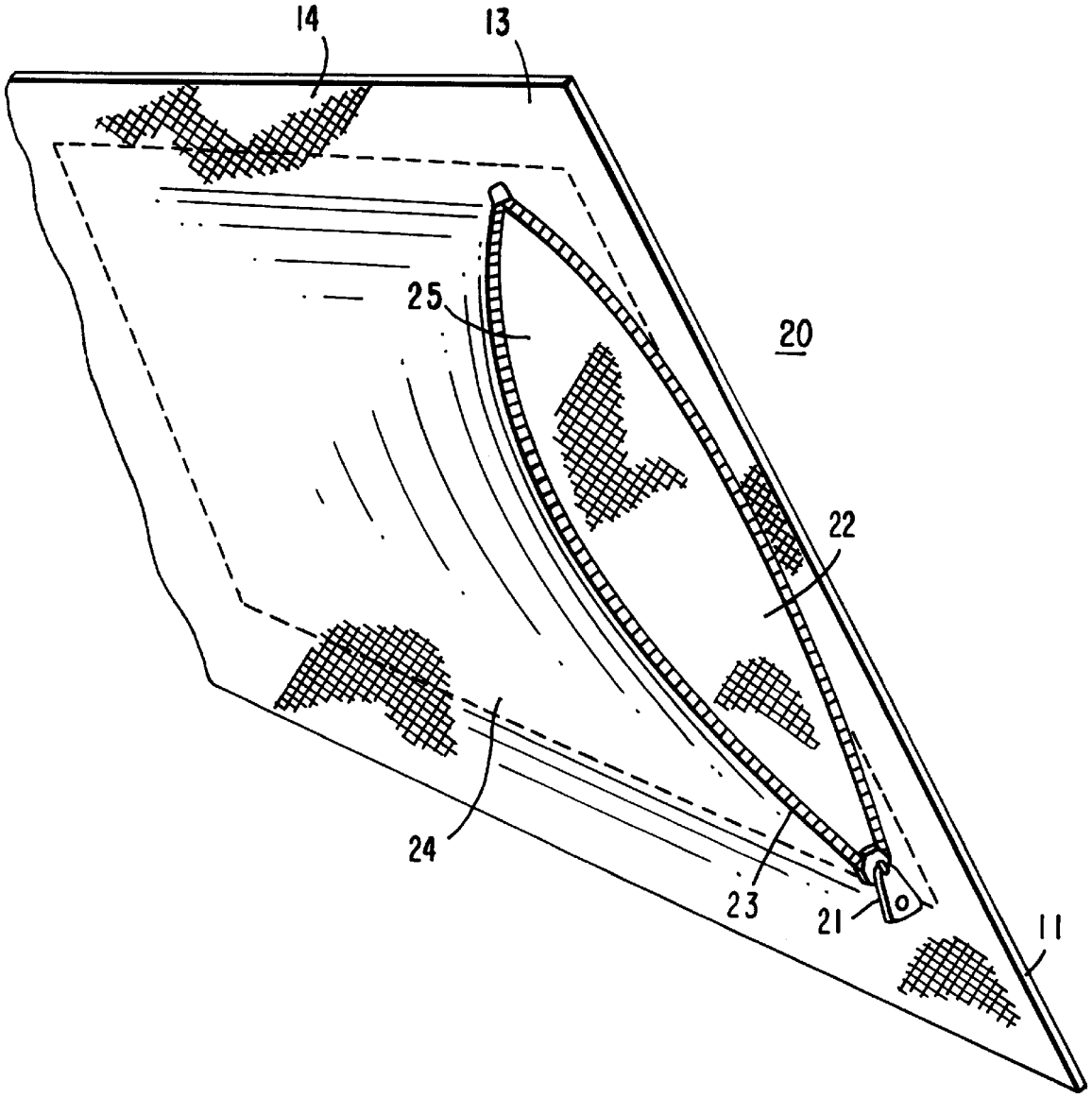
FIG. 2 is a perspective view of the closeable pocket of FIG. 1 showing inside and outside portions of the closeable pocket, the pocket being shown in its open condition.

As shown in FIG. 1, in a preferred embodiment of the present invention, a jacket 10 includes a zippered pocket 20 located adjacent the front zipper 11 and extending to the inside of the left breast 12 of the jacket 10. As shown in FIGS. 1 and 2, the zippered pocket 20 includes a zipper 21, a vertical opening 22, a pocket facing 23, a top pocket lining 24 and a bottom pocket lining 25. The zipper 21 is formed of a metal or plastic material. The pocket facing 23 is formed of the shell material of the jacket, such as a nylon material. The top pocket lining 24 and the bottom pocket lining 25 also are formed of the lining material of the jacket, such as a nylon material.

The vertical opening 22 of the zippered pocket 20 is approximately 9–10 inches long so as to allow for entry of a standard embroidery equipment therein. The zippered pocket 20 is approximately 8–9 inches wide.

The preferred method of producing a garment having a closeable pocket designed to conceal the backing of post-production embroidery on the garment and designed to allow insertion of standard embroidery equipment in the pocket comprises the steps of cutting a vertical slit into the jacket lining 14 or the jacket facing 13 to form the vertical opening 22 of the zippered pocket 20; sewing the pocket facing 23 to the top pocket lining 24; sewing a front edge of the top pocket lining 24 to the back side of the zipper 21, opening the top pocket lining 24 and the bottom pocket lining 25 and framing a front of the zipper 21 to the vertical opening 22 by turning a raw edge of the vertical opening 22 under a finished edge stitch in order to catch the jacket lining 14, the top pocket lining 24 and the bottom pocket lining 25; reinforcing a top and a bottom of the zipper 21 with extra tacking in the horizontal direction; sewing the top pocket lining 24 and the bottom pocket lining 25 closed; sewing through the bottom pocket lining 25 and the top pocket lining 24 in order to catch a top of the zippered pocket 20 and keep it flat; and catching, while setting a sleeve lining of the jacket 10, a back edge of the zippered pocket 20 so as to reinforce and further secure the zippered pocket 20.

Figure 3:
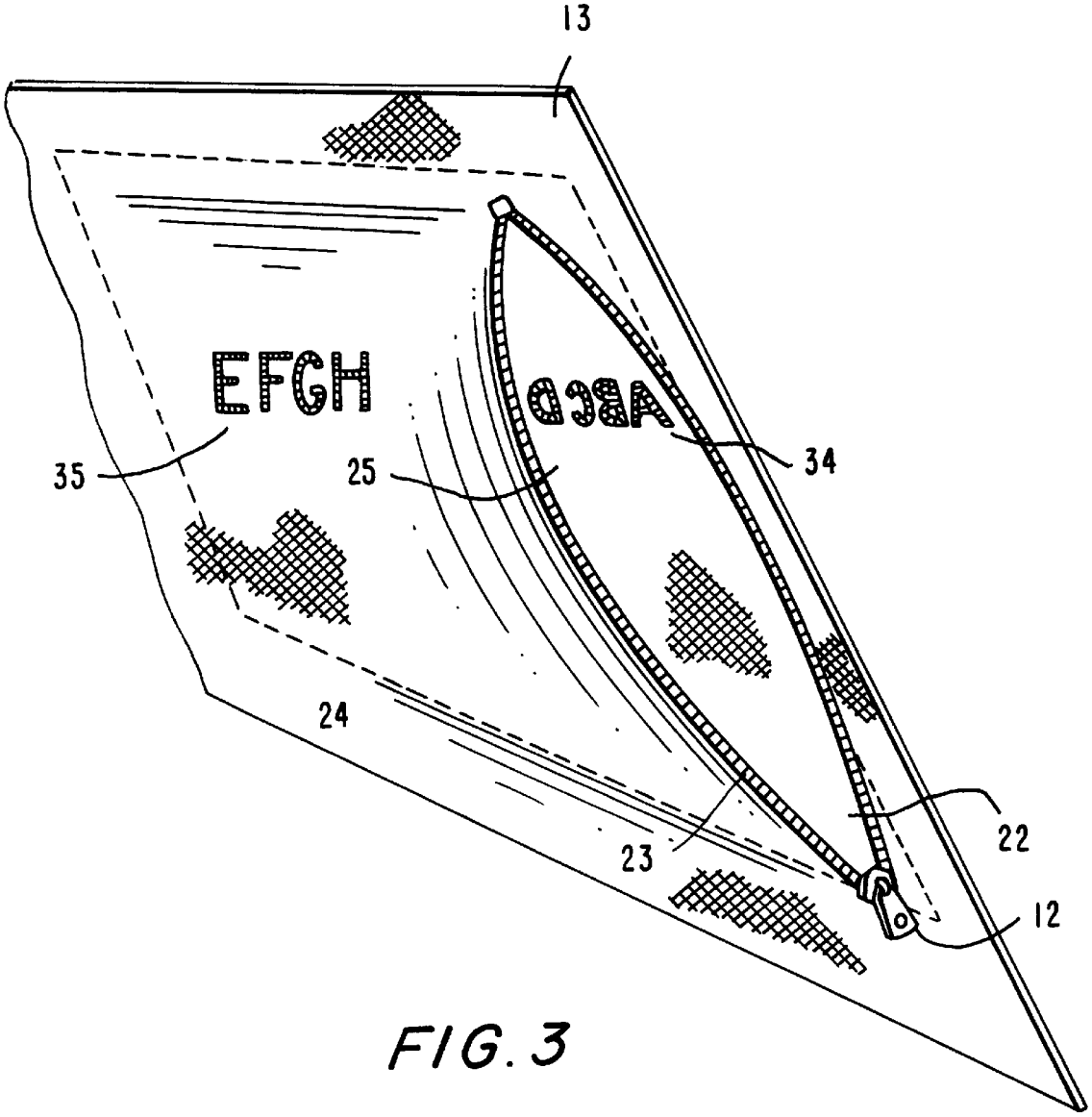
FIG. 3 is a perspective view of the closeable pocket of FIG. 1 showing the back of an embroidered logo.
Figure 4:
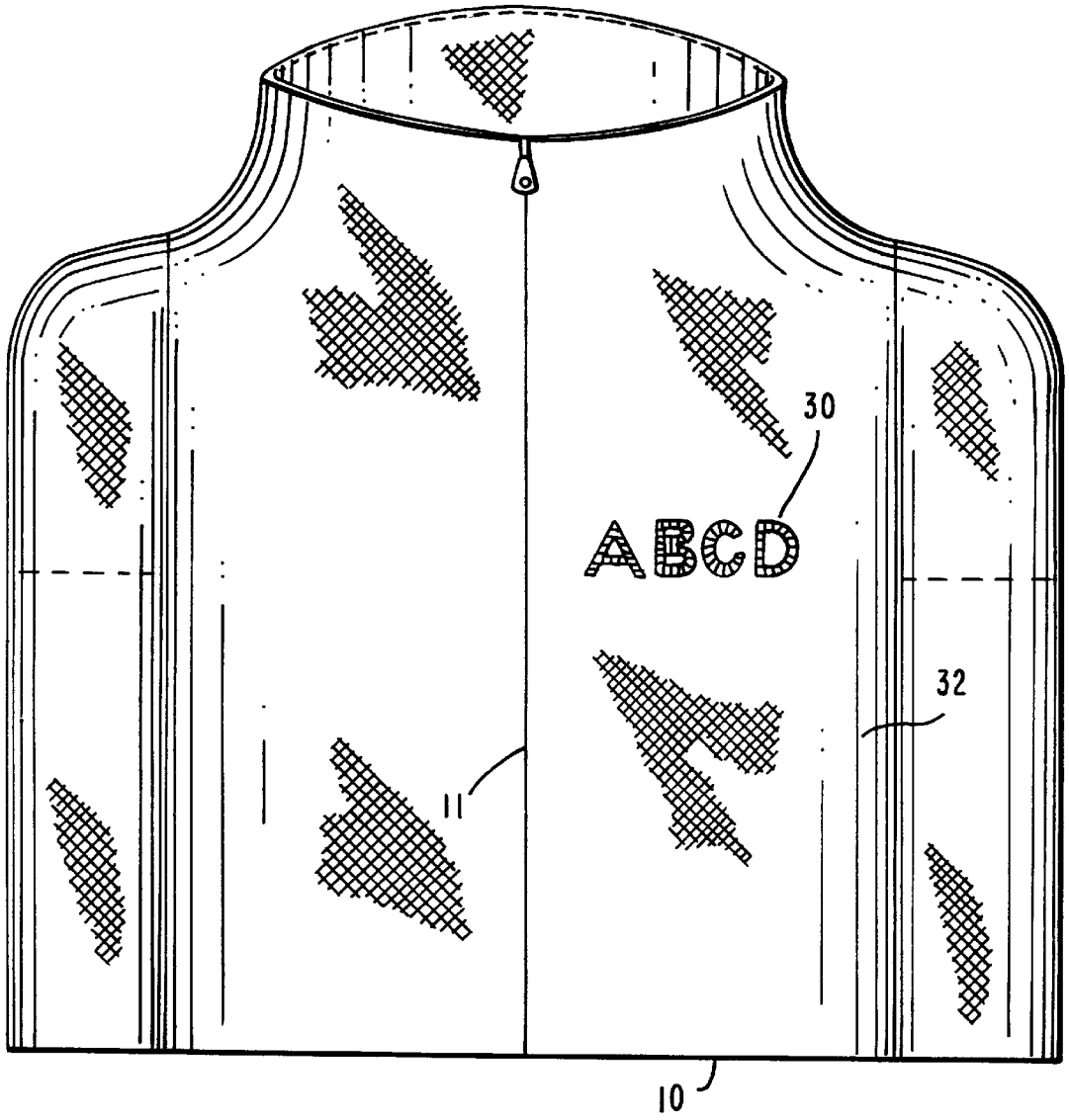
FIG. 4 is a front view of a jacket having a logo embroidered on the outside jacket shell.

A preferred method of embroidering a garment with a zippered pocket that allows for insertion of embroidery equipment therein comprises the steps of opening the zippered pocket 20; inserting standard embroidering equipment into the zippered pocket 20; operating the embroidering equipment; and pulling the zippered pocket 20 inside out to trim the embroidered logo. As seen in FIGS. 3 and 4, the resulting embroidered logo 30 is visible on outside jacket shell 32. Embroidery backing 34 is visible on bottom pocket lining 25, and is concealed when zipper 21 is closed.

Figure 5:
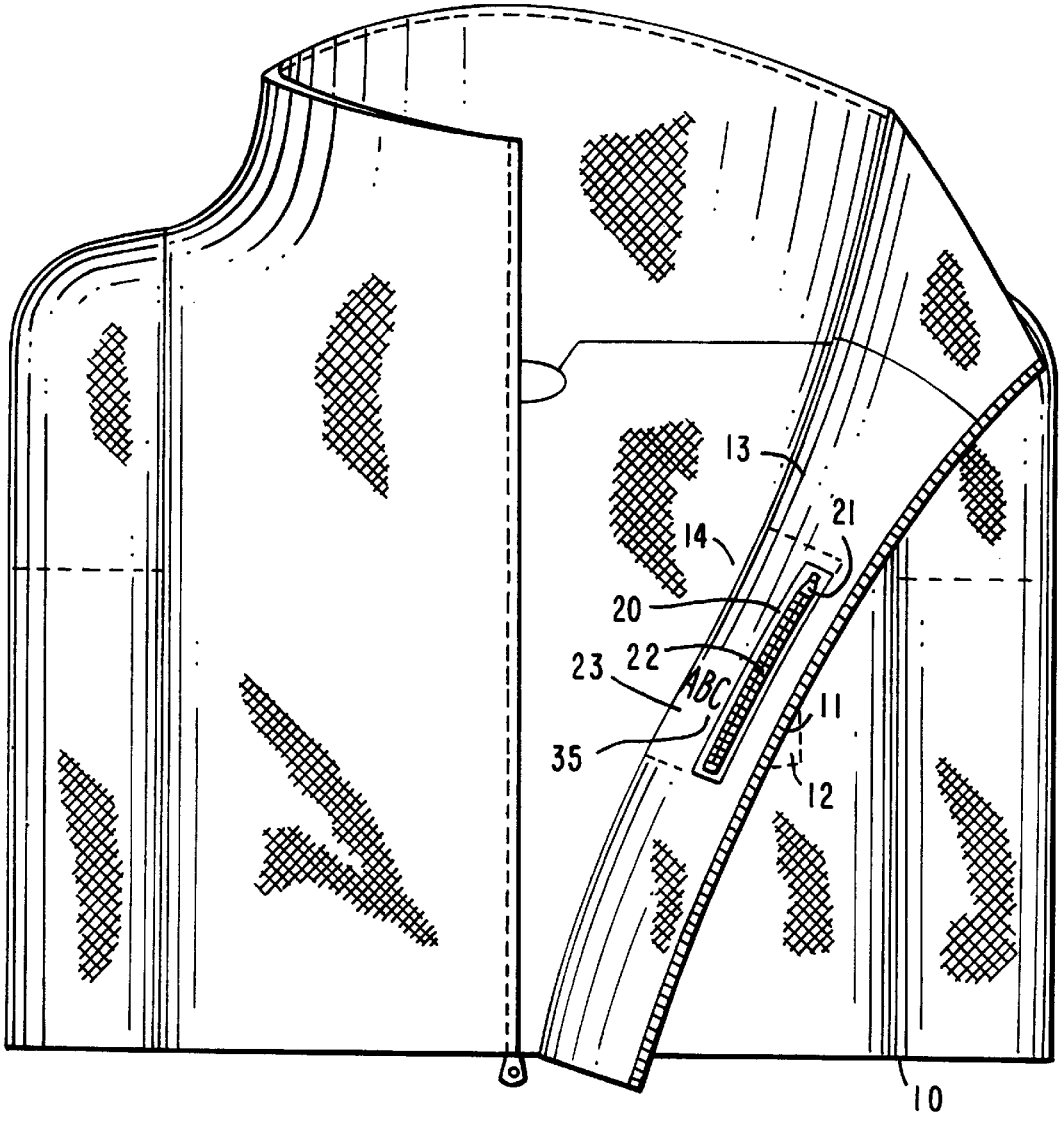
FIG. 5 is a front view of the closeable pocket of FIG. 1 having an embroidered logo visible on the interior of the pocket.

In another embodiment of the invention, as shown in FIGS. 3 and 5, a garment such as jacket 10 can be embroidered to create a design or logo 35 such as a monogram or name that is visible on the interior pocket facing 23. Such embroidery is desirable to personalize garments where a different logo is embroidered on the outside jacket shell 32, or where embroidery on outside jacket shell 32 is not desired. In such an embodiment, the zippered pocket 20 is opened, embroidery equipment is inserted into the zippered pocket 20 and oriented such that the desired logo 35 will be visible on the interior pocket facing 23; the embroidery equipment is operated and the zippered pocket 20 is pulled inside out to trim the embroidered logo. The resulting embroidered logo 35 is visible on interior pocket facing 23. The corresponding embroidery backing is visible on the reverse side of pocket facing 23, inside pocket 20, and is concealed when zipper 21 is closed.

The preferred embodiments and methods described above are illustrative of the invention, which is not limited to the embodiment and methods described. Various changes and modifications may be made in the invention by one skilled in the art without departing from the spirit or scope of the invention.

What is claimed is:

1. A garment having an interior closeable pocket which conceals post-production embroidery on said garment and which enables the use of standard embroidery equipment to embroider the garment, wherein said closeable pocket has an opening for allowing insertion of standard embroidery equipment within the pocket, said closeable pocket comprising:

a pocket facing formed from a shell material of the garment;

a top pocket lining formed from a lining material of the garment;

a bottom pocket lining formed from the lining material of the garment, facing the top pocket lining and attached at its edges to the top pocket facing; and closure means on the pocket facing for closing the pocket opening.

2. The garment of claim 1, wherein said garment is a jacket.

3. The garment of claim 1, wherein said closure means is a zipper.

4. The garment of claim 3, wherein said zipper is 9 inches long.

5. The garment of claim 1, wherein said closure means is a hook and loop fastener.

6. The garment of claim 1, wherein said opening of said pocket is 9 inches long.

7. The garment of claim 1, wherein said post-production embroidery is on the exterior of said garment.

8. The garment of claim 1, wherein said post-production embroidery is on the interior of said garment.

* * * * *